US005856398A

United States Patent [19]

Oizumi et al.

[11] Patent Number: 5,856,398

[45] Date of Patent: Jan. 5, 1999

[54] AQUEOUS PIGMENT DISPERSION FOR LIGHT-SHIELDING PAPER

[75] Inventors: Tetsuro Oizumi; Kosaku Tsuji; Hisao Tanaka; Tsutomu Fujigamori, all of Tokyo, Japan

[73] Assignee: Toyo Ink Manufacturing Co., Ltd., Japan

[21] Appl. No.: 825,501

[22] Filed: Mar. 31, 1997

[30] Foreign Application Priority Data

Apr. 8, 1996 [JP] Japan ..... 8-084972

[51] Int. Cl.[6] ..... C08K 3/04; C08K 3/26; C08K 3/30; C08K 3/34

[52] U.S. Cl. ..... 524/496; 524/406; 524/407; 524/413; 524/423; 524/425; 524/430; 524/431; 524/432; 524/445; 524/446; 524/447; 524/420; 524/436; 524/495

[58] Field of Search ..... 524/431, 413, 524/495, 496, 497, 406, 407, 423, 425, 430, 432, 445, 446, 420, 436, 447

[56] References Cited

U.S. PATENT DOCUMENTS

| | | | |
|---|---|---|---|
| 4,719,038 | 1/1988 | Sobata et al. | 524/435 |
| 5,204,401 | 4/1993 | Anderson, Jr. et al. | 524/446 |
| 5,378,335 | 1/1995 | Hoppe-Höffler et al. | 524/403 |

FOREIGN PATENT DOCUMENTS

| | | |
|---|---|---|
| 6-184987 | 7/1994 | Japan . |
| 7-1676 | 1/1995 | Japan . |
| 7-82691 | 3/1995 | Japan . |

*Primary Examiner*—Peter A. Szekely
*Attorney, Agent, or Firm*—Parkhurst & Wendel, L.L.P.

[57] ABSTRACT

There is provided an aqueous pigment dispersion for a light-shielding paper comprising a pigment component, an aqueous resin and water, wherein the pigment component contains 2 to 50% by weight of graphite in which at least 80% of the total number of particles thereof has the maximum diameter of 1 to 30 $\mu$m, 2 to 60% by weight of a colored pigment, and 10 to 90% by weight of a white pigment, and each specific gravity of the colored pigment and the white pigment is 2.0 to 6.0 g/cm$^3$. The pigment dispersion of the present invention can provide light-shielding properties by rendering coating onto a paper base material and also can provide a light-shielding paper which facilitates recycling and has a high quality when recycling of waste paper is effected.

13 Claims, No Drawings

AQUEOUS PIGMENT DISPERSION FOR LIGHT-SHIELDING PAPER

BACKGROUND OF THE INVENTION

1. Field of the Invention

The present invention relates to an aqueous pigment dispersion which can impart light-shielding properties to a paper base material for wrapping photosensitive materials, foods, phamaceuticals, and the like by coating or printing the dispersion onto the base material and which provides a light-shielding paper which facilitates recycling of waste paper.

2. Description of the Related Art

As a paper base material having light-shielding properties for wrapping a photosensitive material and other materials to be protected from the action of light, which may degenerate due to the action of light, there conventionally exist two typical processes: one is the process in which an aluminum foil and polyolefin resin film are laminated on a base paper; and the other is the process in which polyolefin resin containing carbon black used as a light-shielding pigment is laminated on a base paper or polyolefin resin is laminated on a black base paper into which carbon black is incorporated. However, when these materials are used, maceration properties and separating properties of paper fibers and pigments are extremely deteriorated (at the time of recycling of waste paper), recycling of waste paper is difficult, and these paper materials must be incinerated or buried under the ground as industrial wastes.

As a paper material in which the above-described drawbacks are improved and light-shielding properties and separation properties are both excellent, and a process for manufacturing the paper material, there have been proposed the following: a process in which a mixture of acrylic resin emulsion and wax-type emulsion is applied to a base paper into which inorganic pigments such as carbon black is incorporated or to a base paper surface on which a coating layer of inorganic pigments such as carbon black or a deposit layer such as aluminum is provided (Japanese Patent Application Laid-Open (JP-A) No. 6-184987); a process in which a light-shielding layer containing, as main components, inorganic pigments such as carbon black, aluminum paste, or the like, and a moisture barrier layer containing acrylic resin emulsion and wax-type emulsion are provided on a paper base material (Japanese Patent Application Laid-Open (JP-A) No. 7-82691), and the like. However, although the paper base materials having light-shielding properties, manufactured by these processes, each exhibit maceration properties in which base paper is easily macerated into fibers, these materials do not exhibit sufficient recycling properties in a case that these materials are collected as waste paper to be recycled. For this reason, these materials are impractical for recycling purposes.

When carbon black is used, carbon black cannot be removed unless a deinking process is used. For this reason, in most of common corrugated fiberboard manuracturers in which the deinking process cannot be effected, carbon black appears on a surface of a recycled paper and the commercial value of the recycled paper deteriorates. As a result, practical recycling of such papers cannot be achieved. Further, when aluminum paste is used, aluminum powder cannot be removed even in the deinking process and contamination with the aluminum powder cannot be prevented. For this reason, in this case as well, recycling cannot be achieved.

As a conventional deinking process of waste paper, a flotation process in which ink particles are allowed to adhere to air bubbles, and are floated to be separated, a washing process to be effected by using an appropriate filtering/washing machine and using a combination of a surface active agent, and a decker machine or an inclined screen so that ink particles are stabilized in a washable state, and a combination process in which the flotation process and the washing process are used together are known. When the flotation process is used, high yield is obtained, and an amount of water consumed is less than or equal to a quarter of that in the case of the washing process due to circulating used of recycled water. As a result, the flotation process is superior to the washing method, but the paper obtained by using the flotation process is inferior in quality to that obtained by using the washing process. On the other hand, the washing process generally requires a washing-water purifying equipment, and also requires chemicals. As a result, the washing process is inferior to the flotation process in cost.

Further, since the surface of a paper with carbon black used is black, printing or character typing cannot be rendered thereon. In order to improve printing suitability, whitening processing must be effected for or a printable paper must be laminated onto the surface of the paper.

In addition, as a paper material in which the above-described drawbacks are improved and light-shielding properties, moisture-proof properties, and recycling suitability are excellent, and the process for manufacturing the paper material, there has been known a process in which a light-shielding layer containing, as principal components, yellow pigments such as benzidine yellow, and a moisture-proof layer containing wax-type emulsion and synthetic-rubber-type latex or a resin-type latex are provided on a paper base material (Japanese Patent Application Laid-Open (JP-A) No. 7-1676). The light-shielding properties obtained by this process is limited to light ranging from 250 to 500 nm which is the range of a photosensitive wavelength of a diazo-type photosensitive material required as a wrapping material of a PS (presensitized) printing plate, and do not allow shading of light whose wavelength is in a wide range from ultraviolet region to infrared region, the light being shaded by aluminum foil or carbon black.

SUMMARY OF THE INVENTION

In view of the above-described circumstances, it is an object of the present invention to provide a dispersion for a light-shielding paper, which is used to obtain the light-shielding paper having excellent light-shielding properties, maceration properties which facilitates a recycling process of waste paper, and recycling properties which facilitates reutilization without using aluminum, carbon black, and plastic film.

The present invention is an aqueous pigment dispersion for a light-shielding paper comprising a pigment component, an aqueous resin and water, wherein the pigment component contains 2 to 50% by weight of graphite in which at least 80% of the total number of particles thereof has the maximum diameter of 1 to 30 $\mu$m, 2 to 60% by weight of a colored pigment, and 10 to 90% by weight of a white pigment.

Further, the present invention is constructed in that, in the above-described aqueous pigment dispersion for a light-shielding paper, each specific gravity of the colored pigment and the white pigment is 2.0 to 6.0 g/cm$^3$.

DESCRIPTION OF THE PREFERRED EMBODIMENTS

In the present invention, the amount of graphite to be added is 2 to 50% by weight of a pigment composition.

When the amount of graphite to be added is less than 2% by weight, sufficient light-shielding properties cannot be obtained. When the amount of graphite to be added is greater than 50% by weight, the stability required for a dispersion becomes deteriorated. Addition of colored pigment allows improvement of color saturation and the amount of colored pigment to be added is 2 to 60% by weight, preferably 15 to 50% by weight in view of the required hue. The amount of white pigment to be added is 10 to 90% by weight so as to be opaque, preferably 15 to 40% by weight.

In the present invention, flake graphite exhibits sufficient light-shielding properties. The maximum particle diameter of flake graphite is in a range of 1 to 30μm, preferably 1.5 to 8 μm. When each particle is regarded as a rectangle, it is characterized that the length of a longer side of the rectangle is one third or more of the maximum particle diameter. When the maximum diameter is less than 1 μm, the productivity deteriorates and lightness index L* decreases. For this reason, it becomes difficult to render printing or character-typing on the surface of the light-shielding paper. Further, when the maximum diameter is greater than 30 μm, orientation of particles becomes ununiform and sufficient light-shielding properties cannot be obtained. In addition, the surface smoothness of a coating film is deteriorated and the commercial value decreases depending on purposes. In order to measure the particle diameter of the particles of the present invention, a measured value obtained by a laser scattering process is employed.

As the colored pigment used in the present invention, various inorganic pigments used for printing ink, paint, and the like and some organic pigments can be used. For example, as the organic pigment, a chlorinated phthalocyanine pigment (C.I. Pigment Blue 15:2, Green 7, Green 36) can be used. Examples of inorganic pigments include iron oxide, ultramarine blue, iron blue, cobalt oxide, strontium chromate, titanium yellow, titanium black, zinc chromate, iron black, molybdate red, molybdate white, lithopone, emerald green, cadmium yellow, cadmium red, cobalt blue, and the like.

Examples of the white pigment can include titanium dioxide, zinc oxide, calcium carbonate, china clay, barium sulfate, and the like.

The ratio of total amounts of the light-shielding materials consisted of the pigment components of the present invention to the dispersion is 10 to 80% by weight, preferably 25 to 70% by weight. Further, the ratio of resin to the light-shielding materials is 2.5 to 20% by weight, preferably 5 to 15% by weight.

When a paper base material for a light-shielding paper is recycled on which a conventional dispersion, to which additives are added to form paint or ink, is coated or printed, the specific gravity of carbon black is generally about 1.8 and particles thereof are generally fine so that these particles are not sedimented in the liquid in a recycling process and tend to float. On the other hand, each specific gravity of graphite, the colored pigment and the white pigment used for the pigment dispersion of the present invention is in the range of 2.0 to 6.0 g/cm$^3$. When the specific gravity is lower than 2.0 g/cm$^3$, sedimentation of graphite or pigments does not progress during the recycling process and separation thereof from paper fibers is difficult. Further, when the specific gravity is higher than 6.0 g/cm$^3$, the stability of the dispersion becomes deteriorated.

On the other hand, when the dispersion of the present invention is used, pigment components are separated by sedimentation by utilizing a great difference in the specific gravity of the pigment components, and therefore, the recycling process which is effected more easily than the above-described flotation process or washing process can be achieved. Further, since the particle diameter of the pigments in the dispersion of the present invention is uniformly made larger as compared with that of carbon black, these pigments are not incorporated into the paper material unlike carbon black and recycling of waste paper is facilitated.

The dispersion is obtained in such a manner that graphite, colored pigments, white pigments, dispersing resin, and water are mixed and pre-dispersed, and thereafter, are dispersed again by a dispersing device such as a sand mill.

Further, the pigment dispersion of the present invention allows to impart hue of the pigments which are usable, including color of kraft paper by appropriately selecting types and blending amounts of the colored pigments and white pigments, and allows printing or character-typing on the surface of a coated paper, in which carbon black is used, the surface of which is black, although printing or character-typing on the surface of such paper was impossible due to its black color.

The aqueous resin which can be used in the present invention includes various aqueous resin, for example, copolymers such as acrylic copolymers and styrene/acrylic copolymers and self-crosslinking acrylic copolymer, and the like. These aqueous resins may be used in a dissolved state in water or in an emulsion state. Specific examples of aqueous resins are an acrylic copolymer obtained by copolymerization of styrene or styrene derivatives, acrylic acid (methacrylic acid) and acrylic esters or methacrylic esters such as methyl acrylate, ethyl acrylate, butyl acrylate, and 2-etylhexyl acrylate.

The coating base paper used in the present invention is not particularly limited, and commercially-available paper can be used. Particularly, paper having high smoothness and dense surface and also having high surface sizing degree is preferably used.

As the coating process, conventional coating processes using, for example, a bar coater, air-knife coater, blade coater, roll coater, and the like can be used. Further, a conventional process in the printing field can be applicable.

Further, the drying temperature is not particularly limited. However, since the coating layer may include other layers having various functions in addition to the light-shielding layer, the drying temperature is preferably set at a melting point or higher of wax used for other layers. Drying processing at 70° C. to 150° C. which is set experientially in view of the drying time exerts no influence on the characteristics of the light-shielding layer.

The aqueous pigment dispersion of the present invention obtained in the above-describe manner, which provides light-shielding properties by being applied to a paper and provides a light-shielding paper which facilitates recycling, prevents occurrence of contamination of a roll of a paper machine when waste paper is recycled without carbon black or aluminum paste being used, and causes no great difference in hue between the recycled paper and the kraft paper. As a result, no problem occurs in the commercial value of the recycled paper in appearance.

EXAMPLES

The present invention will be further described hereinafter in detail with reference to the following examples, but is not limited to the same. Note that the terms "paper" and "light-shielding paper" may include film and light-shielding film, respectively.

The results of the light-shielding properties in the examples and comparative examples described below are shown in Table 1 and the results of hue measurement and the results of evaluation of recycling properties are shown in Table 2.

[Example 1]

16.7 parts by weight of graphite (specific gravity is 2.7 g/cm$^3$) in which 85% of the total number of particles thereof has the maximum diameter of 3 to 7.5 $\mu$m, 16.7 parts by weight of iron oxide red which is a colored pigment (manufactured by Nihon Bengara Kohgyo Co., Ltd.; trade name: EP-40; specific gravity: 5.0 g/cm$^3$), 33.3 parts by weight of yellow iron oxide (manufactured by Titan Kogyo K. K.; trade name: Tarox LL-XLO; specific gravity: 4.0 g/cm$^3$), and 33.3 parts by weight of titanium dioxide which is a white pigment (manufactured by Ishihara Sangyo Kaisha, Ltd.; trade name: Tipaque R-930) were mixed as the pigment components, and a styrene/acrylic resin (manufactured by Johnson Polymer Kabushiki Kaisha; trade name: Joncryl 68) was added thereto and dispersed at a ratio of 60:5.6 (=pigments:resin) to prepare a dispersion by use of a sand mill.

The resultant dispersion was mixed with an emulsion (manufactured by Toyo Ink Mfg. Co., Ltd.; trade name: Tocryl PC-52) at a ratio of 5:3.2 to prepare a coating liquid. Thereafter, the coating liquid was applied by an automatic bar coater to a PET (polyethyleneterephthalate) film to form a coated layer having a thickness of 24 $\mu$m so that a light-shielding film was obtained. The transmittance of the obtained light-shielding film in the range of wavelength of 900 to 250 nm is, as shown in Table 1, 0.5 or less for each wavelength and this provides light-shielding properties sufficient for wrapping of photosensitive materials or the like.

Subsequently, the above-described coating liquid was applied on a kraft paper by using an automatic bar coater in a manner similar to the above and dried to obtain a light-shielding paper. The lightness index L* of this light-shielding paper was 49.7. After cutting the light-shielding paper into chips, 4% aqueous sodium hydroxide was added thereto and heated at the temperature of 60° C. for one hour. After the resultant solution was mixed by a mixer to be completely fibrous, a sample solution was allowed to stand. The pigments of the light-shielding materials were completely sedimented. For this reason, separation of the pigments from paper fibers was effected very easily. By using the obtained paper materials, a recycled paper (handmade paper) was prepared and evaluated. As the result of observation of the surface of the recycled paper, no great difference in hue between the recycled paper and the kraft virgin paper was caused and no problem occurred in the commercial value of the recycled paper in appearance. These results actually demonstrates that recycling of waste paper is extremely practical.

[Example 2]

A dispersion was prepared as in Example 1 except that 85% of the total number of particles of graphite in the dispersion had a maximum diameter of 1 to 2.5 $\mu$m to obtain a light-shielding film and a light-shielding paper. The light-shielding properties of the obtained light-shielding film was excellent. Further, the lightness index L* of the obtained light-shielding paper was 44.8 as shown in Table 2, the value being a little smaller than that in Example 1, i.e., a dark hue.

[Example 3]

A dispersion was prepared as in Example 1 except that no iron oxide red was added to the dispersion of Example 1 and the amount of yellow iron oxide to be added was changed from 33.3 parts by weight to 50 parts by weight to obtain a light-shielding film and a light-shielding paper. The light-shielding properties of the obtained light-shielding film was excellent. Further, the lightness index L* of the obtained light-shielding paper was 53.9 as shown in Table 2 and was greater than that in Example 1, i.e., a light hue. As a result, printing properties by use of black ink were more excellent than those in Example 1 and the recycling properties were also excellent.

[Comparative Example 1]

A light-shielding film and a light-shielding paper were obtained as in Example 1 except that carbon black is used in place of graphite. The light transmittance of the obtained light-shielding film in the wavelengths of 900 to 200 nm was, as shown in Table 1, 0.50 or less for each wavelength, which provided sufficient light-shielding properties in practicability. However, the lightness index L* of the obtained light-shielding paper was 36.0, i.e., a black hue. As a result, the light-shielding paper could not be used in view of the printing and character-typing suitability. In addition, after the light-shielding paper was mixed by a mixer to be completely fibrous for recycling, a sample solution thereof was allowed to stand. As a result, pigments other than carbon black were substantially completely sedimented, but carbon black was not sedimented and adhered to paper fibers. The obtained recycled paper was in dark color as compared with the color of the virgin kraft paper and the deinking process was required.

[Comparative Example 2]

A dispersion was prepared as in Example 1 except that without adding graphite to the dispersion of Example 1, the amount of each of titanium dioxide and yellow iron oxide was changed from 33.3 to 40 parts by weight, and the amount of iron oxide red was changed from 16.6 to 20 parts by weight, to obtain a light-shielding film and light-shielding paper. The obtained light-shielding film exhibited the light-shielding properties in the wavelengths of 500 to 250 nm in a similar manner to those in Example 1, but did not exhibit sufficient light-shielding properties in the wavelengths of 900 to 500 nm as shown in Table 1.

[Comparative Example 3]

A light-shielding film and a light-shielding paper were prepared as in Example 1 except that graphite having a maximum particle diameter less than 1 $\mu$m was used. The light transmittance of the obtained light-shielding film was, as shown in Table 1, 0.10 or less for each wavelength in the wavelengths of 900 to 250 nm. Namely, the light-shielding properties similar to those of Example 1 were obtained. However, the lightness index L* of the light-shielding paper was 39.7, i.e., a dark hue as compared with that in Example 1. As a result, the obtained light-shielding paper was not suitable for use in printing and character-typing.

TABLE 1

| | Component ratio of pigments in paint | | | | |
|---|---|---|---|---|---|
| | Graphite | $TiO_2$ | Iron oxide red | Ochre | Others |
| Example 1 | 16.6 | 33.4 | 16.6 | 33.4 | |
| Example 2 | 16.6 | 33.4 | | 33.4 | |

TABLE 1-continued

| | | | | | |
|---|---|---|---|---|---|
| Example 3 | 16.6 | 33.4 | | 50 | |
| Comp. Example 1 | | 33.4 | 16.6 | 33.4 | 16.6 Carbon |
| Comp. Example 2 | | 20 | 40 | 40 | |
| Comp. Example 3 | 16.6 | 33.4 | 16.6 | 33.4 | |

| | Transmittance of each wavelength (%) | | | | | | | |
|---|---|---|---|---|---|---|---|---|
| | 250 nm | 300 nm | 400 nm | 500 nm | 600 nm | 700 nm | 800 nm | 900 nm |
| Example 1 | 0.48 | 0.01 | 0.00 | 0.00 | 0.10 | 0.12 | 0.32 | 0.47 |
| Example 2 | 0.49 | 0.01 | 0.00 | 0.01 | 0.32 | 0.34 | 0.41 | 0.48 |
| Example 3 | 0.49 | 0.01 | −0.01 | 0.01 | 0.40 | 0.42 | 0.45 | 0.46 |
| Comp. Example 1 | 0.43 | 0.01 | −0.01 | 0.00 | 0.02 | 0.06 | 0.16 | 0.48 |
| Comp. Example 2 | 3.59 | 0.02 | 0.04 | 0.09 | 3.19 | 24.60 | 39.51 | 44.27 |
| Comp. Example 3 | 4.22 | 0.01 | 0.00 | 0.04 | 0.71 | 1.70 | 2.72 | 3.65 |

Note: "Comp. Example 1, 2 or 3 means comparative example 1, 2 or 3.

TABLE 2

| | Hue of surface of light-shielding paper | | | Quality of |
|---|---|---|---|---|
| | L* | a* | b* | recycled paper |
| Example 1 | 49.7 | 5.11 | 9.49 | ○ |
| Example 2 | 44.8 | 1.03 | 11.6 | ○ |
| Example 3 | 53.9 | −3.09 | 14.2 | ○ |
| Comp. Example 1 | 36.0 | −0.21 | 0.48 | x |
| Comp. Example 2 | 58.8 | 23.3 | 24.5 | ○ |
| Comp. Example 3 | 44.3 | 1.82 | 5.22 | Δ |

Note: "Comp. Example 1, 2 or 3 means comparative example 1, 2 or 3.
Criteria of evaluation:
Number of stains on recycled paper
0 to 1: ○
2 to 5: Δ

The test method and the evaluation method used in the examples and comparative examples were as follows:

(1) Light-Shielding Properties

Measured with a 60Ø integrating sphere attachment (for ultraviolet and visible infrared region) being attached to a self-recording spectrophotometer (manufactured by Hitachi, Ltd.; U-3400 type), and indicated at the maximum value of light transmittance in the wavelengths of 250 to 500 nm and 500 to 900 nm.

(2) Hue

By using a color measuring machine (manufactured by Nihon Denshoku Co., Ltd.; Σ80 type), the hue of each light-shielding paper was measured.

(3) Recycling Properties

By using a standard beater (Tappi standard Niagara Beater was used at 3000 rpm: manufactured by Toyo Tester Kohgyo Co., Ltd.) shown in a hand-made paper preparing method for JIS P 8209 pulp test, service water was added to a light-shielding paper of about 2.5 cm square at ordinary temperature so that pulp concentration becomes 3%, and was macerated so that the light-shielding paper was completely formed in a pulp state which was an aggregation of monofibers. By using the macerated pulp solution, hand-made wet sheet was prepared by use of a square-type sheet machine (manufactured by Tester Sangyo Industry Co., Ltd.), and thereafter, the number of stains on the recycled paper was counted, and evaluation was made visually.

(4) Particle Diameter Measuring Method

By using a laser-type diffraction particle-size-distribution measuring device (manufactured by JEOL Ltd.; HELOS & RODOS), the diameter of fine particles was determined in a dry state.

In the above-described manner, when the light-shielding paper obtained from the aqueous dispersion for light-shielding obtained in accordance with the present invention is used for a wrapping material for a photosensitive material or the like to shield light ranging from one portion of infrared regions to one portion of ultraviolet and visual regions, the contents wrapped therein can be protected from the light. Further, since paper is used, the light-shielding paper exerts no influence on the environment, and further can be easily recycled. Since a high quality of the recycled paper can be obtained, the light-shielding paper is suitably used as wrapping materials of a photosensitive material, thermosensitive recording paper, photographic printing paper, which require light-shielding properties, and foods, phamaceuticals and the like, which tend to be deteriorated by the action of light or the like.

What is claimed is:

1. An aqueous pigment dispersion for a light-shielding paper comprising a pigment component, at least one of a water soluble resin and a water dispersible resin and water, wherein the pigment component contains 2 to 50% by weight of graphite in which at least 80% of the total number of particles thereof has the maximum diameter of 1 to 30 $\mu$m, 2 to 60% by weight of a colored pigment, and 10 to 90% by weight of a white pigment.

2. An aqueous pigment dispersion for a light-shielding paper according to claim 1, wherein each specific gravity of the colored pigment and the white pigment is 2.0 to 6.0 g/cm$^3$.

3. An aqueous pigment dispersion for a light-shielding paper according to claim 1, wherein the colored pigment is at least one inorganic pigment selected from the group consisting of iron oxide, ultramarine blue, iron blue, cobalt oxide, strontium chromate, titanium yellow, titanium black, zinc chromate, iron black, molybdate red, emerald green, cadmium yellow, cadmium red, and cobalt blue.

4. An aqueous pigment dispersion for a light-shielding paper according to claim 2, wherein the colored pigment is at least one inorganic pigment selected from the group consisting of iron oxide, ultramarine blue, iron blue, cobalt oxide, strontium chromate, titanium yellow, titanium black, zinc chromate, iron black, molybdate red, emerald green, cadmium yellow, cadmium red, and cobalt blue.

5. An aqueous pigment dispersion for a light-shielding paper according to claim 1, wherein the white pigment is at least one inorganic pigment selected from the group consisting of titanium dioxide, zinc oxide, calcium carbonate, china clay, and barium sulfate.

6. An aqueous pigment dispersion for a light-shielding paper according to claim 2, wherein the white pigment is at least one inorganic pigment selected from the group consisting of titanium dioxide, zinc oxide, calcium carbonate, china clay, and barium sulfate.

7. An aqueous pigment dispersion for a light-shielding paper according to claim 4, wherein the white pigment is at least one inorganic pigment selected from the group consisting of titanium dioxide, zinc oxide, calcium carbonate, china clay, and barium sulfate.

8. An aqueous pigment dispersion for a light-shielding paper according to claim 1, wherein the graphite is flaky graphite.

9. An aqueous pigment dispersion for a light-shielding paper according to claim 2, wherein the graphite is flaky graphite.

10. An aqueous pigment dispersion for a light-shielding paper according to claim 7, wherein the graphite is flaky graphite.

11. An aqueous pigment dispersion for a light-shielding paper according to claim 1, wherein the at least one of a water soluble resin and a water dispersible resin is at least one resin selected from the group consisting of an acrylic copolymer and an acryl/styrene copolymer.

12. An aqueous pigment dispersion for a light-shielding paper according to claim 2, wherein the at least one of a water soluble resin and a water dispersible resin is at least one resin selected from the group consisting of an acrylic copolymer and an acryl/styrene copolymer.

13. An aqueous pigment dispersion for a light-shielding paper according to claim 10, wherein the at least one of a water soluble resin and a water dispersible resin is at least one resin selected from the group consisting of an acrylic copolymer and an acryl/styrene copolymer.

* * * * *